US009058774B2

(12) United States Patent
Ahn et al.

(10) Patent No.: US 9,058,774 B2
(45) Date of Patent: Jun. 16, 2015

(54) PIXEL AND ORGANIC LIGHT EMITTING DISPLAY USING THE SAME

(75) Inventors: Jeong-Keun Ahn, Yongin (KR); Wang-Jo Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 134 days.

(21) Appl. No.: 13/467,135

(22) Filed: May 9, 2012

(65) Prior Publication Data

US 2013/0201087 A1 Aug. 8, 2013

(30) Foreign Application Priority Data

Feb. 3, 2012 (KR) ..... 10-2012-0011161

(51) Int. Cl.

| | |
|---|---|
| ***G09G 3/32*** | (2006.01) |
| *G09G 3/30* | (2006.01) |
| *G09G 3/20* | (2006.01) |

(52) U.S. Cl.

CPC ..... *G09G 3/3233* (2013.01); *G09G 3/2014* (2013.01); *G09G 2300/0847* (2013.01)

(58) Field of Classification Search

None

See application file for complete search history.

(56) References Cited

U.S. PATENT DOCUMENTS

| | | | | |
|---|---|---|---|---|
| 2007/0085847 | A1* | 4/2007 | Shishido | 345/204 |
| 2008/0150437 | A1 | 6/2008 | Iida et al. | |
| 2010/0141564 | A1 | 6/2010 | Choi et al. | |
| 2010/0207863 | A1 | 8/2010 | Yen et al. | |
| 2012/0169785 | A1* | 7/2012 | Kawabe | 345/690 |
| 2012/0293478 | A1* | 11/2012 | Chaji et al. | 345/212 |

FOREIGN PATENT DOCUMENTS

| | | | |
|---|---|---|---|
| EP | 0717446 | A2 | 6/1996 |
| EP | 2006904 | A2 | 12/2008 |
| KR | 10-2007-0025151 | A | 3/2007 |
| KR | 10-2010-0064620 | | 6/2010 |
| WO | WO 2005/015532 | A1 | 2/2005 |

OTHER PUBLICATIONS

European Search Report Dated Jan. 3, 2013.

* cited by examiner

*Primary Examiner* — Amr Awad
*Assistant Examiner* — Donna Lui
(74) *Attorney, Agent, or Firm* — Lee & Morse, P.C.

(57) ABSTRACT

A pixel includes a first transistor coupled between a first power source and a first node, the first transistor including a gate electrode coupled to a second node, an organic light emitting diode (OLED) coupled between the first node and a second power source, a second transistor for supplying a data signal to the second node in response to a scan signal, a third transistor having a source electrode and a drain electrode electrically coupled to each other, the third transistor being coupled to the first power source and the second node, and a fourth transistor having a source electrode and a drain electrode electrically coupled to each other, the fourth transistor being coupled between the second node and the first node.

17 Claims, 7 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2012-0011161, filed on Feb. 3, 2012, in the Korean Intellectual Property Office, the entire content of which is incorporated herein by reference.

BACKGROUND

1. Field

Embodiments relate to a pixel and an organic light emitting display using the same.

2. Description of the Related Art

Recently, various flat panel displays (FPD) capable of reducing weight and volume, which are disadvantages of cathode ray tubes (CRT), have been developed. The FPDs include liquid crystal displays (LCD), field emission displays (FED), plasma display panels (PDP), and organic light emitting displays.

Among the FPDs, the organic light emitting displays may display images using organic light emitting diodes (OLED) that generate light by the re-combination of electrons and holes. The organic light emitting display may have a high response speed and may be driven with low power consumption.

The organic light emitting display may be divided into a passive matrix type (PMOLED) and an active matrix type (AMOLED) in accordance with a method of driving the OLEDs in the display.

SUMMARY

According to an embodiment, there is provided a pixel including a first transistor coupled between a first power source and a first node, the first transistor including a gate electrode coupled to a second node, an organic light emitting diode (OLED) coupled between the first node and a second power source, a second transistor for supplying a data signal to the second node in response to a scan signal, a third transistor having a source electrode and a drain electrode electrically coupled to each other, the third transistor being coupled to the first power source and the second node, and a fourth transistor having another source electrode and another drain electrode electrically coupled to each other, the fourth transistor being coupled between the second node and the first node.

The data signal may have a first voltage or a second voltage set to have a larger value than the first voltage.

The third transistor may be configured to operate as a MOS capacitor when a data signal having the first voltage is supplied to the second node. The fourth transistor may be configured to operate as a MOS capacitor when a data signal having the second voltage is supplied to the second node.

The third transistor may be configured to be driven in a strong inversion mode when the data signal having the first voltage is supplied to the second node. The fourth transistor is configured to be driven in a strong inversion mode when the data signal having the second voltage is supplied to the second node.

The third transistor and the fourth transistor may each include a semiconductor layer on a substrate, a gate insulating layer on the semiconductor layer, a gate electrode on the gate insulating layer, an interlayer insulating layer on the gate electrode and the gate insulating layer. The source electrode and the drain electrode of the third transistor and the other source electrode and other drain electrode of the fourth transistor may be on the interlayer insulating layer and may be electrically coupled to the semiconductor layer through contact holes in the gate insulating layer interlayer insulating layer.

The source electrode, the drain electrode, the other source electrode and the other drain electrode may be in a form of one plate above the gate electrode. The plurality of contact holes may be formed at an edge of the plate such that a contact area between the source and drain electrodes and the semiconductor layer of the third transistor and another contact area between the other source and drain electrodes and the semiconductor layer of the fourth transistor are increased.

The first to fourth transistors may be PMOS transistors or NMOS transistors.

According to an embodiment, there is provided an organic light emitting display, including a pixel unit including pixels coupled to scan lines, data lines, a first power source, and a second power source, a scan driver for supplying scan signals to the pixels through the scan lines, and a data driver for supplying data signals to the pixels through the data lines, wherein each pixel includes an organic light emitting diode (OLED) coupled between a first node and the second power source, a first transistor coupled between the first power source and the first node, the first transistor including a gate electrode coupled to a second node, a second transistor for supplying a data signal to the second node in response to a scan signal, a third transistor having a source electrode and a drain electrode electrically coupled to each other, the third transistor being coupled between the first power source and the second node, and a fourth transistor having another source electrode and another drain electrode electrically coupled to each other, the fourth transistor being coupled between the second node and the first node.

The data signal may have a first voltage or a second voltage, the second voltage having a larger value than the first voltage.

The third transistor may be configured to operate as a MOS capacitor when the data signal having the first voltage is supplied to the second node. The fourth transistor may be configured to operate as a MOS capacitor when the data signal having the second voltage is supplied to the second node.

The third transistor may be configured to be driven in a strong inversion mode when the data signal having the first voltage is supplied to the second node. The fourth transistor may be configured to be driven in a strong inversion mode when the data signal having the second voltage is supplied to the second node.

The third transistor and the fourth transistor may each include a semiconductor layer on a substrate, a gate insulating layer on the semiconductor layer, a gate electrode on the gate insulating layer, an interlayer insulating layer on the gate electrode and the gate insulating layer. The source electrode and the drain electrode of the third transistor and the other source electrode and other drain electrode of the fourth transistor may be on the interlayer insulating layer and may be electrically coupled to the semiconductor layer through contact holes in the gate insulating layer interlayer insulating layer.

The source electrode, the drain electrode, the other source electrode and the other drain electrode may be in a form of one plate above the gate electrode.

The plurality of contact holes may be formed at an edge of the plate such that a contact area between the source and drain electrodes and the semiconductor layer of the third transistor and another contact area between the other source and drain electrodes and the semiconductor layer of the fourth transistor may be increased.

The first to fourth transistors may be PMOS transistors or NMOS transistors.

BRIEF DESCRIPTION OF THE DRAWINGS

The accompanying drawings, together with the specification, illustrate exemplary embodiments, and, together with the description, serve to explain the principles.

DETAILED DESCRIPTION

Figure 1:
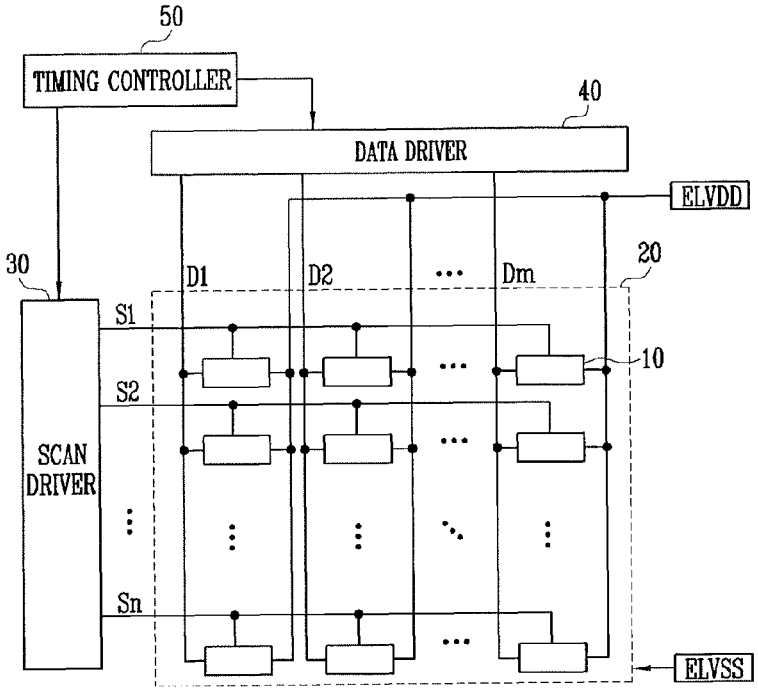
FIG. 1 is a view illustrating an organic light emitting display according to an embodiment.

Korean Patent Application No. 10-2012-0011161, filed on Feb. 3, 2012, in the Korean Intellectual Property Office, and entitled: "Pixel and Organic Light Emitting Display Using the same" is incorporated by reference herein in its entirety.

Detailed items of the other embodiments are included in detailed description and drawings.

Embodiments will now be described more fully with reference to the accompanying drawings, in which exemplary embodiments of the invention are shown. However, these may be embodied in many different forms and should not be construed as being limited to the embodiments set forth herein. In the drawings, when a part is coupled to another part, the part may be directly coupled to another part and the part may be electrically coupled to another part with another element interposed. In the drawings, parts that are not related to the embodiments may be omitted for clarity of description. The same reference numerals in different drawings represent the same element, and thus their description will be omitted.

Hereinafter, a pixel according to an embodiment and an organic light emitting display using the same will be described with reference to the embodiments and the drawings for describing the embodiments.

FIG. 1 is a view illustrating an organic light emitting display according to an embodiment.

Referring to FIG. 1, the organic light emitting display according to the embodiment includes a pixel unit 20 including pixels 10 coupled to scan lines S1 to Sn, data lines D1 to Dm, a first power source ELVDD, and a second power source ELVSS, a can driver 30 for supplying scan signals to the pixels 10 through the scan lines S1 to Sn, and a data driver 40 for supplying data signals to the pixels 10 through the data lines D1 to Dm. The organic light emitting display may further include a timing controller 50 for controlling the scan driver 30 and the data driver 40.

Each of the pixels 10 is coupled to the first power source ELVDD and the second power source ELVSS.

Each of the pixels 10 that receive the first power source ELVDD and the second power source ELVSS generates light corresponding to a data signal by the current that flows from the first power source ELVDD to the second power source ELVSS via an organic light emitting diode (OLED).

The scan driver 30 generates the scan signals by the control of the timing controller 50 and supplies the generated scan signals to the pixels 10 through the scan lines S1 to Sn.

The data driver 40 generates the data signals by the control of the timing controller 50 and supplies the generated data signals to the pixels 10 through the data lines D1 to Dm.

In addition, the data driver 40 may operate so that the data signals have a first voltage V1 or a second voltage V2. Here, the second voltage V2 may be set to be larger than the first voltage V1.

Figure 2:
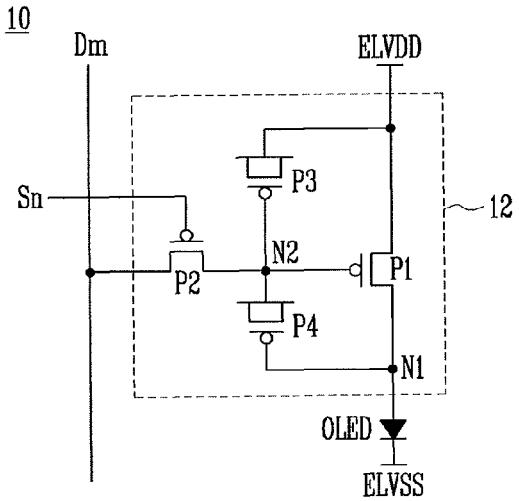
FIG. 2 is a view illustrating a pixel according to the embodiment.

FIG. 2 is a view illustrating a pixel according to the embodiment. In FIG. 2, for convenience sake, the pixel 10 coupled to the nth scan line Sn and the mth data line Dm will be illustrated.

In particular, in this embodiment, transistors P1 to P4 that constitute the pixel 10 may be p-type metal oxide semiconductor field effect (PMOS) transistors.

Referring to FIG. 2, each of the pixels 10 according to an embodiment includes the organic light emitting diode (OLED) and a pixel circuit 12 coupled to the data line Dm and the scan line Sn to control the amount of current supplied to the OLED.

The anode electrode of the OLED may be coupled to the pixel circuit 12 and the cathode electrode of the OLED is coupled to the second power source ELVSS. The OLED generates light of predetermined brightness to correspond to the current supplied from the pixel circuit 12.

The pixel circuit 12 controls the current that flows from the first power source ELVDD to the second power source ELVSS via the OLED to correspond to the data signal supplied to the data line Dm when the scan signal is supplied to the scan line Sn. Therefore, the pixel circuit 12 may include a first transistor P1, a second transistor P2, a third transistor P3, and a fourth transistor P4.

The OLED is coupled between a first node N1 and the second power source ELVSS. In detail, the anode electrode of the OLED may be coupled to the first node N1 and the cathode electrode of the OLED may be coupled to the second power source ELVSS.

The first transistor P1 as a driving transistor generates the current corresponding to the data signal supplied to the gate electrode of the first transistor P1 to supply the generated current to the OLED. Therefore, the first transistor P1 is coupled between the first power source ELVDD and the first node N1 and the gate electrode of the first transistor P1 is coupled to a second node N2.

In detail, the source electrode of the first transistor P1 may be coupled to the first power source ELVDD and the drain electrode of the first transistor P1 may be coupled to the first node N1.

The second transistor P2 may supply the data signal to the second node N2 in response to the supply of the scan signal. The second transistor P2 is turned on when the scan signal is supplied from the scan line Sn and supplies the data signal from the data line Dm to the gate electrode of the first transistor P1.

Therefore, the first transistor P1 generates the current corresponding to the voltage level of the data signal supplied to the gate electrode thereof to supply the generated current to the OLED.

In detail, the gate electrode of the second transistor P2 may be coupled to the scan line Sn, the source electrode of the second transistor P2 may be coupled to the data line Dm, and the drain electrode of the second transistor P2 may be coupled to the second node N2.

The third transistor P3 may operate as a kind of metal oxide semiconductor (MOS) capacitor. The source electrode of the third transistor P3 may be electrically coupled to the drain electrode of the third transistor P3. In detail, the source electrode and the drain electrode of the third transistor P3 may be coupled to the first power source ELVDD, and the gate electrode of the third transistor P3 may be coupled to the second node N2. Therefore, the source and drain electrodes of the third transistor P3 may be electrically coupled to each other and may be electrically coupled to the source electrode of the first transistor P1.

In particular, when a voltage (for example, the first voltage V1 of the data signal) is low enough that a channel is formed in a semiconductor layer is supplied to the gate electrode of the third transistor P3, the semiconductor layer and the gate electrode of the third transistor P3 between which a gate insulating layer is interposed may operate as one capacitor having predetermined capacitance.

The fourth transistor P4 may operate as a kind of MOS capacitor like the third transistor P3. The source electrode and the drain electrode of the fourth transistor P4 may be electrically coupled to each other. In detail, the source and drain electrodes of the fourth transistor P4 may be coupled to the second node N2, and the gate electrode of the fourth transistor P4 may be coupled to the first node N1. Therefore, the source and drain electrodes of the fourth transistor P4 may be electrically coupled to each other and may be electrically coupled to the gate electrode of the first transistor P1.

In particular, when a voltage (for example, the second voltage V2 of the data signal) is low enough that the channel is formed in the semiconductor layer is supplied to the source and drain electrodes of the fourth transistor P4, the semiconductor layer and the gate electrode of the fourth transistor P4, between which the gate insulating layer is interposed, may operate as one capacitor having predetermined capacitance.

The first node N1 may be defined as a contact point at which the anode electrode of the OLED, the drain electrode of the first transistor P1, and the gate electrode of the fourth transistor P4 are coupled to each other.

The second node N2 may be defined as a contact point at which the gate electrode of the first transistor P1, the drain electrode of the second transistor P2, the gate electrode of the third transistor P3, and the source and drain electrodes of the fourth transistor P4 are coupled to each other.

The first power source ELVDD as a high potential power source is coupled to the source electrode of the first transistor P1.

The second power source ELVSS as a low potential power source having a voltage of a lower level than the first power source ELVDD is coupled to the cathode electrode of the OLED.

Figure 3:
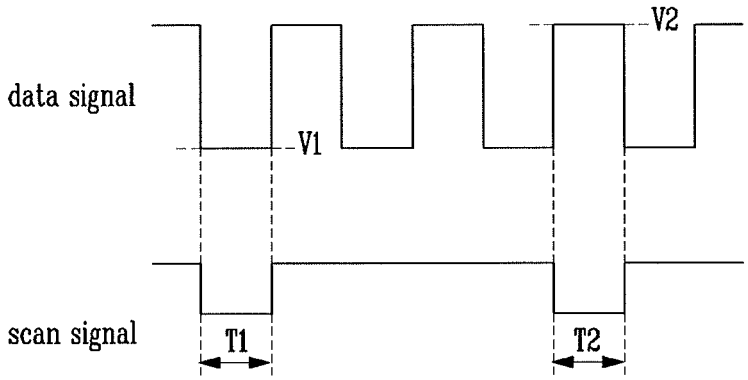
FIG. 3 is a waveform chart illustrating a method of driving the pixel of FIG. 2.

FIG. 3 is a waveform chart illustrating a method of driving the pixel of FIG. 2. Hereinafter, referring to FIGS. 2 and 3, the operation of the pixel 10 according to the embodiment will be described.

First, in a first period T1, a scan signal having a voltage of a low level is supplied and a data signal having the first voltage V1 is supplied.

As the scan signal is supplied, the second transistor P2 is turned on and the data signal is supplied to the second node N2 by the turned-on second transistor P2.

The data signal supplied to the second node N2 has the first voltage V1, which is a sufficiently low voltage such that, as the first voltage V1 is supplied to the gate electrode of the third transistor P3, a channel is formed in the semiconductor layer of the third transistor P3 so that the third transistor P3 operates as a MOS capacitor.

However, as the first voltage V1 is supplied to the source and drain electrodes of the fourth transistor P4, since the channel is not formed in the semiconductor layer of the fourth transistor P4, the fourth transistor P4 does not operate as a MOS capacitor.

Therefore, a voltage corresponding to a difference between the first power source ELVDD and the first voltage V1 may be charged in the third transistor P3 that operates as a MOS capacitor so that the gate-source voltage of the first transistor P1 may be uniformly maintained until a next scan signal is supplied. Thus, the first transistor P1 generates current corresponding to the corresponding gate-source voltage so that the OLED may emit light.

Then, in a second period T2, a scan signal having a voltage of a low level is supplied and a data signal having the second voltage V2 is supplied.

As the scan signal is supplied, the second transistor P2 is turned on and the data signal is supplied to the second node N2 by the turned-on second transistor P2.

The data signal supplied to the second node N2 has the second voltage V2, which is a sufficiently high voltage such that, as the second voltage V2 is supplied to the gate electrode of the third transistor P3, the channel is not formed in the semiconductor layer of the third transistor P3, and the third transistor P3 does not operate as a MOS capacitor.

However, as the second voltage V2 is supplied to the source and drain electrodes of the fourth transistor P4, the channel is formed in the semiconductor layer of the fourth transistor P4 so that the fourth transistor P4 operates as a MOS capacitor.

Therefore, a voltage corresponding to a difference between the second voltage V2 and the voltage (the anode electrode voltage of the OLED) of the first node N1 may be charged in the fourth transistor P4 that operates as a MOS capacitor so that the first transistor P1 is turned off, until a next scan signal is supplied, to stop the emission of the OLED.

Thus, in the first period T1 where the data signal having the first voltage V1 is supplied, the third transistor P3 may operate as a MOS capacitor. However, in the second period T2 where the data signal having the second voltage V2 is supplied, the fourth transistor P4 may operate as the MOS capacitor.

In addition, when the data signal having the first voltage V1 is supplied to enhance the capacitor characteristic of the third transistor P3, the third transistor P3 may operate in a strong inversion mode. When the data signal having the second voltage V2 is supplied in order to enhance the capacitor characteristic of the fourth transistor P4, the fourth transistor P4 may operate in the strong inversion mode.

Therefore, the first voltage V1 of the data signal may be set to have a voltage value of no more than the anode electrode voltage of the OLED and the second voltage V2 of the data signal may be set to have a voltage value of no less than that of the first power source ELVDD.

Figure 4:
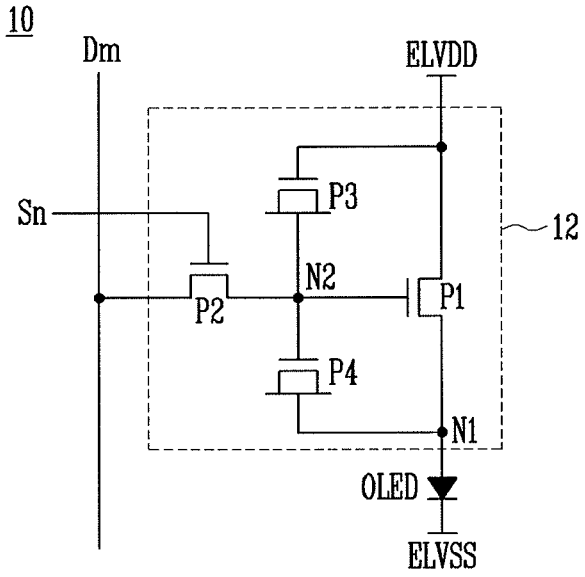
FIG. 4 is a view illustrating a pixel according to another embodiment.

FIG. 4 is a view illustrating a pixel according to another embodiment. In particular, in this embodiment, the transistors P1 to P4 that constitute the pixel 10 are n-type metal oxide semiconductor field effect (NMOS) transistors.

In this case, most of the elements of the pixel illustrated in FIG. 4 are the same as the elements of the pixel illustrated in FIG. 2. However, the conduction type of the pixel illustrated in FIG. 4 is the reverse of the conduction type of the pixel illustrated in FIG. 2. Accordingly, the coupling relationship between the third transistor P3 and the fourth transistor P4 is reversed.

That is, the source and drain electrodes of the third transistor P3 are coupled to the second node N2 and the gate electrode of the third transistor P3 is coupled to the first power source ELVDD.

In addition, the source and drain electrodes of the fourth transistor P4 are coupled to the first node N1 and the gate electrode of the fourth transistor P4 is coupled to the second node N2.

As a description of the operation of the pixel according to the present embodiment, in the case where the scan signal having the voltage of the high level is supplied and the data signal having the first voltage V1 is supplied, the data signal is supplied to the second node N2 by the turned-on second transistor P2.

The data signal supplied to the second node N2 has the first voltage V1, which is a sufficiently low voltage such that, as the first voltage V1 is supplied to the source and drain electrodes of the third transistor P3, a channel is formed in the semiconductor layer of the third transistor P3 so that the third transistor P3 operates as a MOS capacitor.

However, as the first voltage V1 is supplied to the gate electrode of the fourth transistor P4, since the channel is not formed in the semiconductor layer of the fourth transistor P4, the fourth transistor P4 does not operate as a MOS capacitor.

Therefore, the voltage corresponding to the difference between the first power source ELVDD and the first voltage V1 may be charged in the third transistor P3, which operates as a MOS capacitor. The gate-source voltage of the first transistor P1 may be uniformly maintained until a next scan signal is supplied. Therefore, the first transistor P1 may be turned off in a predetermined period so that the emission of the OLED may be stopped.

When a scan signal having a voltage of a high level is supplied and a data signal having the second voltage V2 is supplied, the data signal is supplied to the second node N2 by the turned-on second transistor P2.

The data signal supplied to the second node N2 has the second voltage V2, which is a sufficiently high voltage such that, as the second voltage V2 is supplied to the source and drain electrodes of the third transistor P3, the channel is not formed in the semiconductor layer of the third transistor P3, and the third transistor does not operate as a MOS capacitor.

However, as the second voltage V2 is supplied to the gate electrode of the fourth transistor P4, the channel is formed in the semiconductor layer of the fourth transistor P4 so that the fourth transistor P4 operates as a MOS capacitor.

Therefore, the voltage corresponding to the difference between the second voltage V2 and the voltage (the voltage of the anode electrode of the OLED) of the first node N1 may be charged in the fourth transistor P4, which operates as a MOS capacitor so that the first transistor P1 generates a current corresponding to the corresponding gate-source voltage until a next scan signal is supplied and that the OLED may emit light.

In addition, when the data signal having the first voltage V1 is supplied to enhance the capacitor characteristic of the third transistor P3, the third transistor P3 may operate in a strong inversion mode. When the data signal having the second voltage V2 is supplied in order to enhance the capacitor characteristic of the fourth transistor P4, the fourth transistor P4 may operate in a strong inversion mode.

Figure 5:
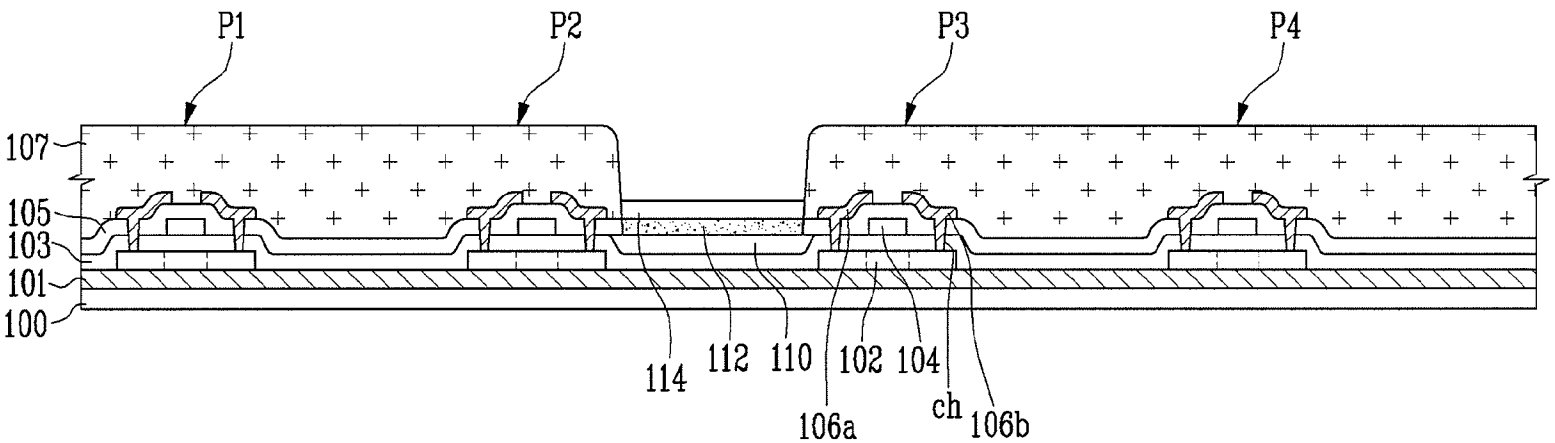
FIG. 5 is a view illustrating the section of the pixel of FIG. 2.
Figure 6:
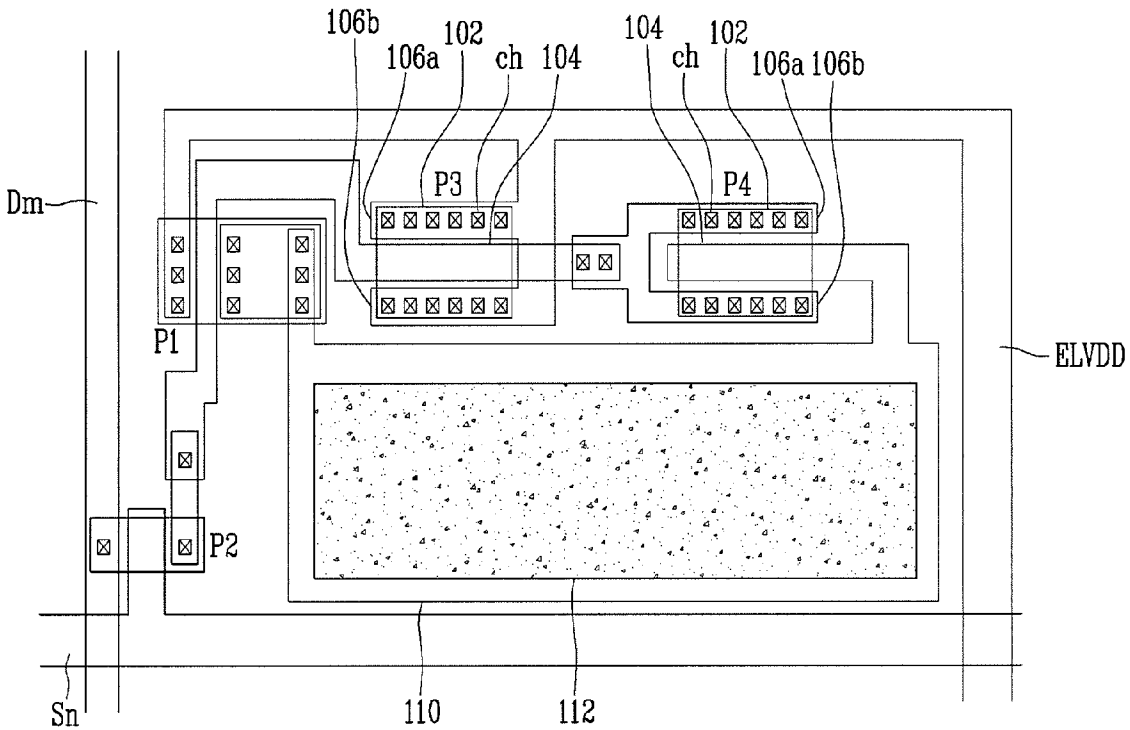
FIG. 6 is a layout diagram illustrating the pixel of FIG. 5.

FIG. 5 is a view illustrating a cross-section of the pixel of FIG. 2. FIG. 6 is a layout diagram illustrating the pixel of FIG. 5.

Referring to FIGS. 5 and 6, the structures of the first to fourth transistors P1 to P4 that constitute the pixel 10 will be described in detail.

The first to fourth transistors P1 to P4 are formed on a substrate 100. The substrate 100 may be formed of a material having an insulation property such as glass, plastic, silicon, or synthetic resin and is preferably formed of a transparent substrate such as a glass substrate.

First, the structure of the third transistor P3 will be representatively described. The third transistor P3 includes a semiconductor layer 102, a gate insulating layer 103, a gate electrode 104, an interlayer insulating layer 105, and source/drain electrodes 106*a* and 106*b*.

In addition, a buffer layer 101 may be formed on the substrate 100. The buffer layer 101 for preventing contamination by impurities contained in the substrate 100 may be formed of an insulating material such as a silicon oxide layer $SiO_2$ or a silicon nitride layer $SiN_X$.

The semiconductor layer 102 is formed on the buffer layer 101 in a predetermined pattern. The semiconductor layer 102 may be formed of low temperature polysilicon (LTPS) obtained by crystallizing amorphous silicon deposited on the buffer layer 101 using a laser.

The gate insulating layer 103 is formed on the semiconductor layer 102. The gate insulating layer 103 may be formed as a nitride layer or an oxide layer, for example, a silicon oxide layer or a silicon nitride layer, or other suitable materials.

The gate insulating electrode 104 is formed on the gate insulating layer 103 in a predetermined pattern. The interlayer insulating layer 105 is formed on the gate electrode 104.

The gate insulating layer 103 insulates the semiconductor layer 102 from the gate electrode 104. The interlayer insulating layer 105 insulates the gate electrode 104 from the source/drain electrodes 106*a* and 106*b*.

The source/drain electrodes 106*a* and 106*b* are formed on the interlayer insulating layer 105. The source/drain electrodes 106*a* and 106*b* are electrically coupled to both sides of the semiconductor layer 102 through contact holes ch formed in the gate insulating layer 103 and the interlayer insulating layer 105.

The gate electrode 104 and the source/drain electrodes 106*a* and 106*b* may be formed of a metal such as Mo, W, Ti, and Al or an alloy or a lamination of the above metals or other suitable materials.

A planarizing layer 107 is formed on the interlayer insulating layer 105 and the source/drain electrodes 106*a* and 106*b* and may be formed of a nitride or a oxide or other suitable materials. The anode electrode 110 of the OLED is formed in a part where the planarizing layer 107 is partially removed. The anode electrode 110 of the OLED is electrically coupled to the drain electrode of the first transistor P1.

In addition, a light emitting layer 112 is formed on the anode electrode 110 of the OLED. The light emitting layer 112 has a structure in which a hole transport layer, an organic light emitting layer, and an electron transport layer are laminated. A hole injection layer and an electron injection layer may be further included.

In addition, the cathode electrode 114 of the OLED is formed on the light emitting layer 112. The cathode electrode 114 of the OLED is coupled to the second power source ELVSS.

The above-described structure of the third transistor P3 may be applied to the remaining transistors P1, P2, and P4. Accordingly, a description of the structure as applied to remaining transistors P1, P2, and P4 will not be repeated.

Figure 7:
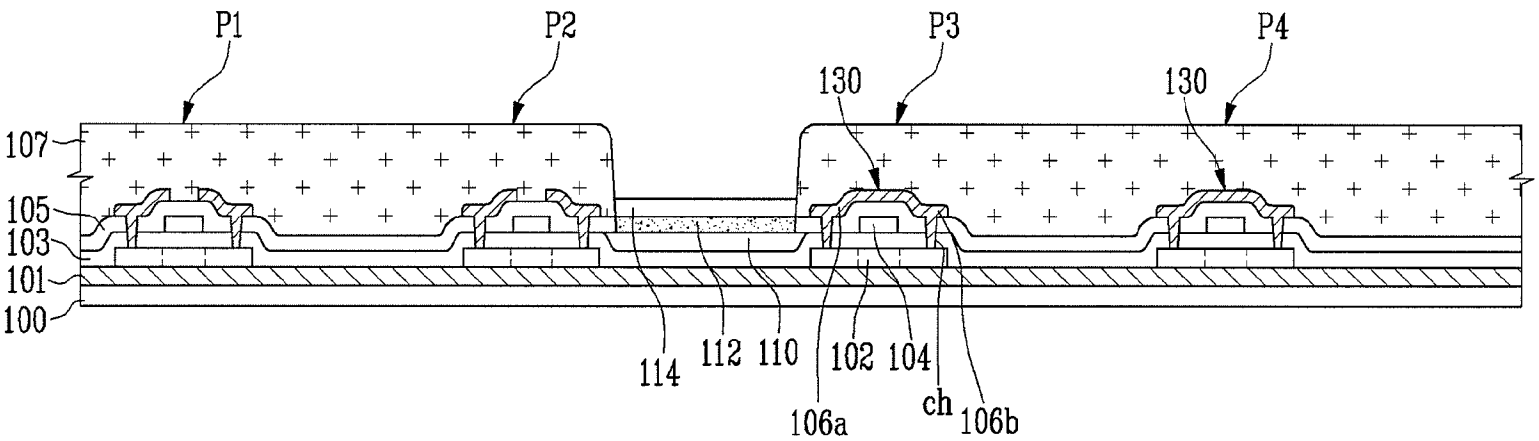
FIG. 7 is a view illustrating the section of a pixel when each of the source and drain electrodes of a third transistor and the source and drain electrodes of a fourth transistor is formed above each of the gate electrode of the third transistor and the gate electrode of the fourth transistor as one plate.
Figure 8:
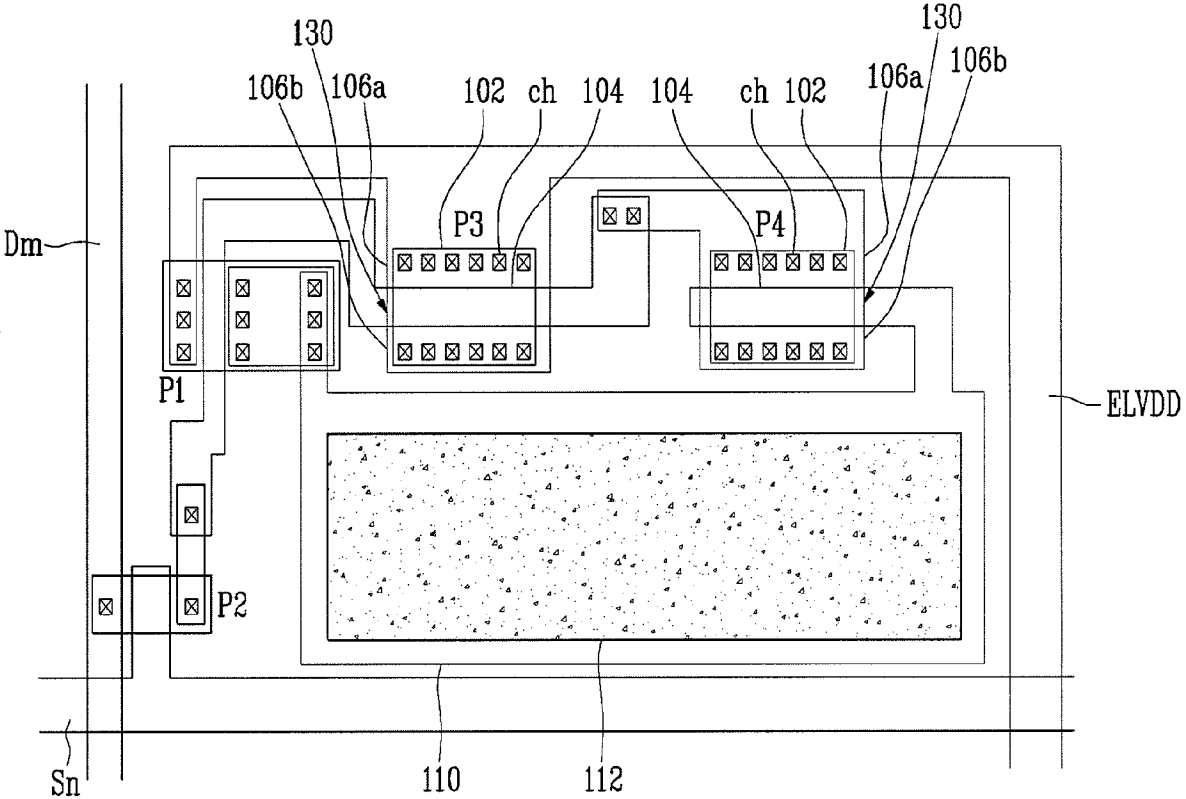
FIG. 8 is a layout diagram illustrating the pixel of FIG. 7.

FIG. 7 is a view illustrating the cross-section of a pixel wherein the source and drain electrodes of a third transistor and the source and drain electrodes of a fourth transistor are each formed above the respective gate electrode of the third transistor and the gate electrode of the fourth transistor as one plate. FIG. 8 is a layout diagram illustrating the pixel of FIG. 7.

Referring to FIGS. 5 and 6, the source electrode 106*a* and the drain electrode 106*b* of each of the third transistor P3 and the fourth transistor P4 may be coupled to each other without contacting the gate electrode 104. However, referring to FIGS. 7 and 8, the source electrode 106*a* and the drain electrode 106*b* of each of the third transistor P3 and the fourth transistor P4 may be formed as one plate 130 above the gate electrode 104.

Therefore, additional capacitance may be secured through an overlapping area formed between the plate 130 formed by the source electrode 106*a* and the drain electrode 106*b* and the gate metal 104.

Figure 9:
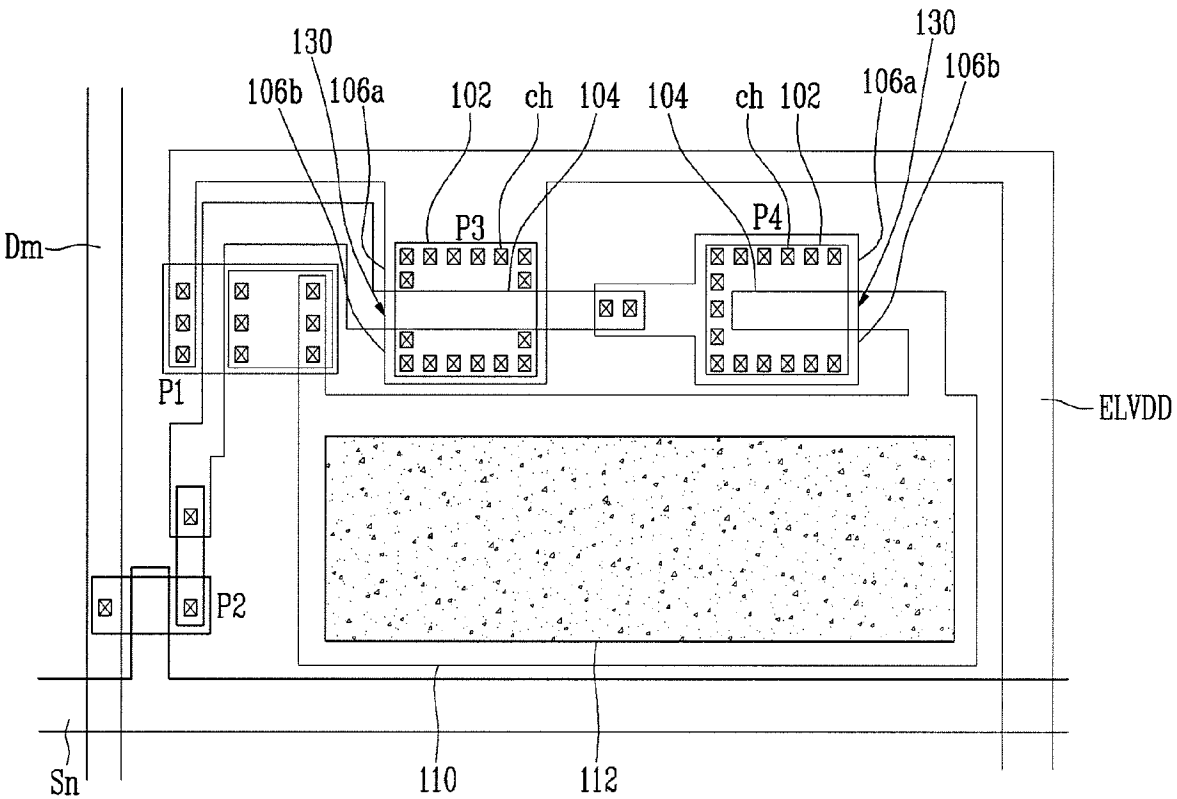
FIG. 9 is a layout diagram illustrating a pixel in which contact holes are additionally formed.

FIG. 9 is a layout diagram illustrating a pixel in which contact holes are additionally formed. Referring to FIG. 9, a plurality of contact holes ch for coupling the source/drain electrodes 106*a* and 106*b* of the third transistor P3 and the fourth transistor P4 to the respective semiconductor layer 102 may be formed at the edge of the plate 130 to increase the contact area between the source/drain electrodes 106*a* and 106*b* and the semiconductor layer 102.

As the contact area between the source/drain electrodes 106*a* and 106*b* and the semiconductor layer 102 increases, the data signal may be stably maintained.

Thus, in the third transistor P3, the contact holes ch may be formed at the edge on the upper and lower sides of the plate 130 formed by the source electrode 106*a* and the drain electrode 106*b*, and additional contact holes ch may be formed at the edge on the right and left sides of the plate 130.

In addition, in the fourth transistor P4, additional contact holes ch may be formed at the edge only on the left side so that the contact area of the source/drain electrodes 106*a* and 106*b* and the semiconductor layer 102 may be increased.

By way of summation and review, an active matrix type organic light emitting display (AMOLED) includes a storage capacitor for charging data signals. The storage capacitor may be in the form of a metal-insulator-metal (MIM) capacitor by doping polycrystalline silicon with impurities. However, in this case, since a channel doping mask for doping semiconductor is to be added, manufacturing time and manufacturing cost are increased. In contrast, exemplary embodiments may provide a pixel of a simple structure and an organic light emitting display using the same, whereby manufacturing time and manufacturing costs may be reduced by omitting a channel doping mask.

While the embodiments been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel, comprising:

a first transistor coupled between a first power source and a first node, the first transistor including a gate electrode coupled to a second node;

an organic light emitting diode (OLED) coupled between the first node and a second power source;

a second transistor configured to supply a data signal to the second node in response to a scan signal;

a third transistor having a source electrode and a drain electrode electrically coupled to each other, the third transistor being coupled to the first power source and the second node; and a fourth transistor having a source electrode and a drain electrode electrically coupled to each other, the fourth transistor being coupled between the second node and the first node, wherein:

the data signal has a substantially constant first value for substantially an entire period of a first time when the second transistor is turned on by the scan signal and the first transistor is turned on, the third transistor to form a first channel and the fourth transistor set to an off state based on the substantially constant first value of the data signal during the first time, formation of the first channel causes the third transistor to operate as a metal oxide semiconductor (MOS) capacitor to store a first difference voltage corresponding to a difference between a voltage of the first power source and the substantially constant first value of the data signal, the first transistor to turn on based on the first difference voltage to cause the OLED to emit light, the data signal has a substantially constant second value for substantially an entire period of a second time when the second transistor is turned on by the scan signal and the first transistor is turned off, the fourth transistor to form a second channel and the third transistor set to an off state based on the substantially constant second value of the data signal during the second time, formation of the second channel causes the fourth transistor to operate as a MOS capacitor to store a second difference voltage corresponding to a difference between the substantially constant second voltage and an electrode voltage of the OLED, the second difference voltage to turn off the first transistor, and the data signal only has the first value and the second value.

2. The pixel as claimed in claim 1, wherein the third transistor is to be driven in a strong inversion mode when the data signal having the first voltage is supplied to the second node, and the fourth transistor is to be driven in a strong inversion mode when the data signal having the second voltage is supplied to the second node.

3. The pixel as claimed in claim 1, wherein:

the third transistor and the fourth transistor include:

a semiconductor layer on a substrate;

a gate insulating layer on the semiconductor layer;

a gate electrode on the gate insulating layer;

an interlayer insulating layer on the gate electrode and the gate insulating layer; and the source electrode and the drain electrode of the third transistor and the source electrode and the drain electrode of the fourth transistor are on the interlayer insulating layer and are electrically coupled to the semiconductor layer through contact holes in the gate insulating layer and the interlayer insulating layer.

4. The pixel as claimed in claim 3, wherein source electrodes and the drain electrodes corresponding to each of the third transistor and the fourth transistor are in a form of one plate above the gate electrode.

5. The pixel as claimed in claim 4, wherein the plurality of contact holes are formed at an edge of the plate such that a first contact area between the source electrode and the drain electrode, and the semiconductor layer of the third transistor and a second contact area between the other source and the drain electrode, and the semiconductor layer of the fourth transistor are increased.

6. The pixel as claimed in claim 1, wherein the first to fourth transistors are p-type metal oxide semiconductor (PMOS) transistors or n-type metal oxide semiconductor (NMOS) transistors.

7. An organic light emitting display, comprising:

a pixel unit including pixels coupled to scan lines, data lines, a first power source, and a second power source;

a scan driver configured to supply scan signals to the pixels through the scan lines; and a data driver configured to supply data signals to the pixels through the data lines, wherein each pixel includes:

an organic light emitting diode (OLED) coupled between a first node and the second power source;

a first transistor coupled between the first power source and the first node, the first transistor including a gate electrode coupled to a second node;

a second transistor configured to supply a data signal to the second node in response to a scan signal;

a third transistor having a source electrode and a drain electrode electrically coupled to each other, the third transistor being coupled between the first power source and the second node; and a fourth transistor having a source electrode and a drain electrode electrically coupled to each other, the fourth transistor being coupled between the second node and the first node, wherein:

the data signal has a substantially constant first value for substantially an entire period of a first time when the second transistor is turned on by the scan signal and the first transistor is turned on, the third transistor to form a first channel and the fourth transistor set to an off state based on the substantially constant first value of the data signal during the first time, formation of the first channel causes the third transistor to operate as a metal oxide semiconductor (MOS) capacitor to store a first difference voltage corresponding to a difference between a voltage of the first power source and the substantially constant first value of the data signal, the first transistor to turn on based on the first difference voltage to cause the OLED to emit light, the data signal has a substantially constant second value for substantially an entire period of a second time when the second transistor is turned on by the scan signal and the first transistor is turned off, the fourth transistor to form a second channel and the third transistor set to an off state based on the substantially constant second value of the data signal during the second time, formation of the second channel causes the fourth transistor to operate as a MOS capacitor to store a second difference voltage corresponding to a difference between the substantially constant second voltage and an electrode voltage of the OLED, the second difference voltage to turn off the first transistor, and the data signal only has the first value and the second value.

8. The organic light emitting display as claimed in claim 7, wherein:

the third transistor is to be driven in a strong inversion mode when the data signal having the first voltage is supplied to the second node, and the fourth transistor is to be driven in a strong inversion mode when the data signal having the second voltage is supplied to the second node.

9. The organic light emitting display as claimed in claim 7, wherein: the third transistor and the fourth transistor include:

a semiconductor layer on a substrate;

a gate insulating layer on the semiconductor layer;

a gate electrode on the gate insulating layer;

an interlayer insulating layer on the gate electrode and the gate insulating layer; and the source electrode and the drain electrode of the third transistor and the source electrode and the drain electrode of the fourth transistor are on the interlayer insulating layer and are electrically coupled to the semiconductor layer through contact holes in the gate insulating layer and the interlayer insulating layer.

10. The organic light emitting display as claimed in claim 9, wherein source electrodes and the drain electrodes corresponding to each of the third transistor and the fourth transistor are in a form of one plate above the gate electrode.

11. The organic light emitting display as claimed in claim 10, wherein the plurality of contact holes are formed at an edge of the plate such that a first contact area between the source electrode and the drain electrode, and the semiconductor layer of the third transistor and a second contact area between the other source and the drain electrode, and the semiconductor layer of the fourth transistor are increased.

12. The organic light emitting display as claimed in claim 7, wherein the first to fourth transistors are PMOS transistors or NMOS transistors.

13. A method, comprising:

providing a first transistor having a source electrode and a drain electrode electrically coupled to each other, the first transistor being coupled to a first power source and a second node;

providing a second transistor having a source electrode and a drain electrode electrically coupled to each other, the second transistor being coupled between the second node and a first node;

providing a third transistor coupled to a scan line, and a fourth transistor to drive an organic light emitting diode;

supplying a scan signal and a data signal having a first voltage during a first period to form a channel in a layer of the first transistor to be operated as a MOS capacitor; and supplying a scan signal and a data signal having a second voltage during a second period to form a channel in a layer of the second transistor to be operated as a MOS capacitor the first voltage being lower than the second voltage of the data signal; and alternatively activating or deactivating of the first transistor or the second transistor according to a periodic application of the first voltage or the second voltage, wherein:

the data signal has a substantially constant first value for substantially an entire period of a first time when the second transistor is turned on by the scan signal and the first transistor is turned on, the third transistor to form a first channel and the fourth transistor set to an off state based on the substantially constant first value of the data signal during the first time, formation of the first channel causes the third transistor to operate as a metal oxide semiconductor (MOS) capacitor to store a first difference voltage corresponding to a difference between a voltage of the first power source and the substantially constant first value of the data signal, the first transistor to turn on based on the first difference voltage to cause the OLED to emit light, the data signal has a substantially constant second value for substantially an entire period of a second time when the second transistor is turned on by the scan signal and the first transistor is turned off, the fourth transistor to form a second channel and the third transistor set to an off state based on the substantially constant second value of the data signal during the second time, formation of the second channel causes the fourth transistor to operate as a MOS capacitor to store a second difference voltage corresponding to a difference between the substantially constant second voltage and an electrode voltage of the OLED, the second difference voltage to turn off the first transistor, and the data signal only has the first value and the second value.

14. The method as claimed in claim 13, wherein a voltage corresponding to a difference between the first power source and the first voltage is charged in the first transistor, and a voltage corresponding to a difference between the second voltage and the voltage of the first node is charged in the second transistor.

15. The pixel as claimed in claim 1, wherein the coupled source and drain electrode of the third transistor is disposed facing a gate electrode of the fourth transistor through the second node.

16. The pixel as claimed in claim 1, wherein the gate electrode of the third transistor is disposed facing the coupled source and drain electrode of the fourth transistor through the second node.

17. The pixel as claimed in claim 1, wherein the third transistor and the fourth transistor are coupled to alternatively activate or deactivate the third transistor or the fourth transistor according to a periodic application of the first voltage or the second voltage.

* * * * *